United States Patent [19]

Hüsges et al.

[11] 4,142,356

[45] Mar. 6, 1979

[54] OPEN-END SPINNING APPARATUS

[75] Inventors: Gerd Hüsges; Eberhard Grimm, both of Ingolstadt, Fed. Rep. of Germany

[73] Assignee: Schubert & Salzer, Ingolstadt, Fed. Rep. of Germany

[21] Appl. No.: 842,116

[22] Filed: Oct. 14, 1977

[30] Foreign Application Priority Data

Oct. 27, 1976 [DE] Fed. Rep. of Germany ..... 2648708

[51] Int. Cl.[2] ..... D01H 11/00; D01H 1/12

[52] U.S. Cl. ..... 57/301; 57/58.89; 57/304

[58] Field of Search ..... 57/56, 58.89–58.95

[56] References Cited

U.S. PATENT DOCUMENTS

| | | | |
|---|---|---|---|
| 3,762,143 | 10/1973 | Stewart | 57/56 |
| 3,792,575 | 2/1974 | Doudlebsky et al. | 57/56 |
| 3,797,218 | 3/1974 | Landwehrkamp et al. | 57/58.89 |
| 3,884,028 | 5/1975 | Stahlecker et al. | 57/56 |
| 3,892,063 | 7/1975 | Doudlebsky et al. | 57/56 |
| 4,036,002 | 7/1977 | Kobayashi | 57/56 X |

*Primary Examiner*—John Petrakes

*Attorney, Agent, or Firm*—Bailey, Dority & Flint

[57] ABSTRACT

An open-end spinning apparatus having a fiber conveying path between a fibrous material feed device and a spinning compartment. A trash separating device which includes an aperture and a dividing edge is provided for removing trash from the fibrous material as it is conveyed along the conveying path extending around an opening roller. A collection chamber is provided for receiving the trash from the trash separating device. Interposed between the trash separating device and collection chamber is an auxiliary chamber. A first aperture extends through a wall of the auxiliary chamber through which a stream of air flows for being introduced into the fiber conveying path. A second aperture is provided in an opposed wall of the auxiliary chamber through which a smaller stream of air is removed from the auxiliary chamber along with small particles of fly and trash. A controllable closing member is disposed between the auxiliary chamber and the trash collection chamber which is closed when air is used for removing the trash collected in the trash collecting chamber.

6 Claims, 3 Drawing Figures

31
41
3
30
1
12
10
11
14
15
21
40
13
4
20
220
223
42
2
22
222
24
240
28
27
26
23
α
221
43
25
250
230
251
260
261
262

OPEN-END SPINNING APPARATUS

BACKGROUND OF THE INVENTION

The present invention relates to an open-end spinning apparatus with a fiber conveying path extending between a feed device and a spinning compartment, and more particularly to a trash separating device utilized therewith.

A trash separating device for open-end spinning apparatuses is already known which comprises a trash separating aperture which is bounded by a dividing edge and which, in turn, is in communication with a trash collecting chamber through which air is supplied to the fiber conveying path (DT-OS No. 1.914.115). In this case, the removal of the extracted trash is effected mechanically or pneumatically (DT-AS No. 1.922.078). It is not possible to remove the fine fly reliably by means of a mechanical removal means since there is a risk of the fly accumulating and re-entering the stream of fiber via the air supplied to the fiber conveying path and eventually entering the spinning compartment where it causes thread breakage. With pneumatic removal of the extracted trash components, either the spinning process is influenced by the stream of air or the trash separating device is put out of action, at least temporarily, by a closing member as a result of which the spinning process is likewise influenced.

SUMMARY OF THE INVENTION

According to the invention, the above problems are minimized by positioning an auxiliary chamber between a fiber conveying path and a trash collecting chamber. The fiber conveying path extends around an opening roll between a fibrous material delivery roll and a spinning compartment. A stream of air is introduced into the fiber conveying path through a first aperture in a wall of the auxiliary chamber. A second aperture is provided in the wall of the chamber below a dividing edge for continuously removing a considerably weaker stream of air from the auxiliary chamber. A controllable closing member is carried between the auxiliary chamber and said trash collecting chamber which can be closed when cleaning the trash collecting chamber.

By means of the device according to the invention, the fine fly and other light trash components which have traversed the air curtain formed by the stream of air introduced, are continuously drawn off. They, therefore, cannot settle on the walls of the auxiliary chamber or on the trash collecting chamber. The communication between the auxiliary chamber and the trash collecting chamber can be briefly interrupted by means of the controllable closing member for pneumatic removal of the trash components which have entered the trash collecting chamber. Meanwhile, the heavier trash components which have been extracted in the meantime collect in the auxiliary chamber and, on re-opening, pass through the closing member into the trash collecting chamber.

The controllable closing member may vary in construction. According to a particularly simple embodiment of the invention, it is constructed in the form of a flap which can be controlled by a stream of air emptying the trash collecting chamber. In order to prevent a rebound of the trash components into the fiber conveying path, the wall of the auxiliary chamber following on the dividing edge preferably forms an angle of less than 30 degrees with a baffle of the trash collecting chamber which collects the trash components. The wall of the auxiliary chamber following on the dividing edge may likewise form an angle of less than 30° with the face of the closing member adjacent to the auxiliary chamber.

Soiling of the trash collecting chamber with fly is avoided by means of the device constructed in accordance with the invention. The auxiliary chamber cannot be soiled with fly because the fine dust and fly extracted are continuously drawn off. For this reason, the fly is not sucked back into the stream of fiber and air supplied to the spinning compartment; therefore, irregularities in the thread and thread breakages attributable to this are avoided.

Accordingly, it is an important object of the present invention to provide a trash removal system for an open-end spinning device wherein a trash collection chamber associated therewith can be cleaned without interrupting the trash separating process.

Another important object of the present invention is to provide a device for removing trash from fibers being fed to an open-end spinning device which prevents an accumulation of fine fly in an auxiliary chamber associated with the device.

Still another important object of the present invention is to provide an apparatus for removing trash from fibrous material being fed to an open-end spinning device which minimizes the accumulation of fine fly in a removal device and which can be operated without interrupting the trash separating operation.

These and other objects and advantages of the invention will become apparent upon reference to the following specification, attendant claims, and drawing.

DESCRIPTION OF THE PREFERRED EMBODIMENT

Figures 1, 2, 3:
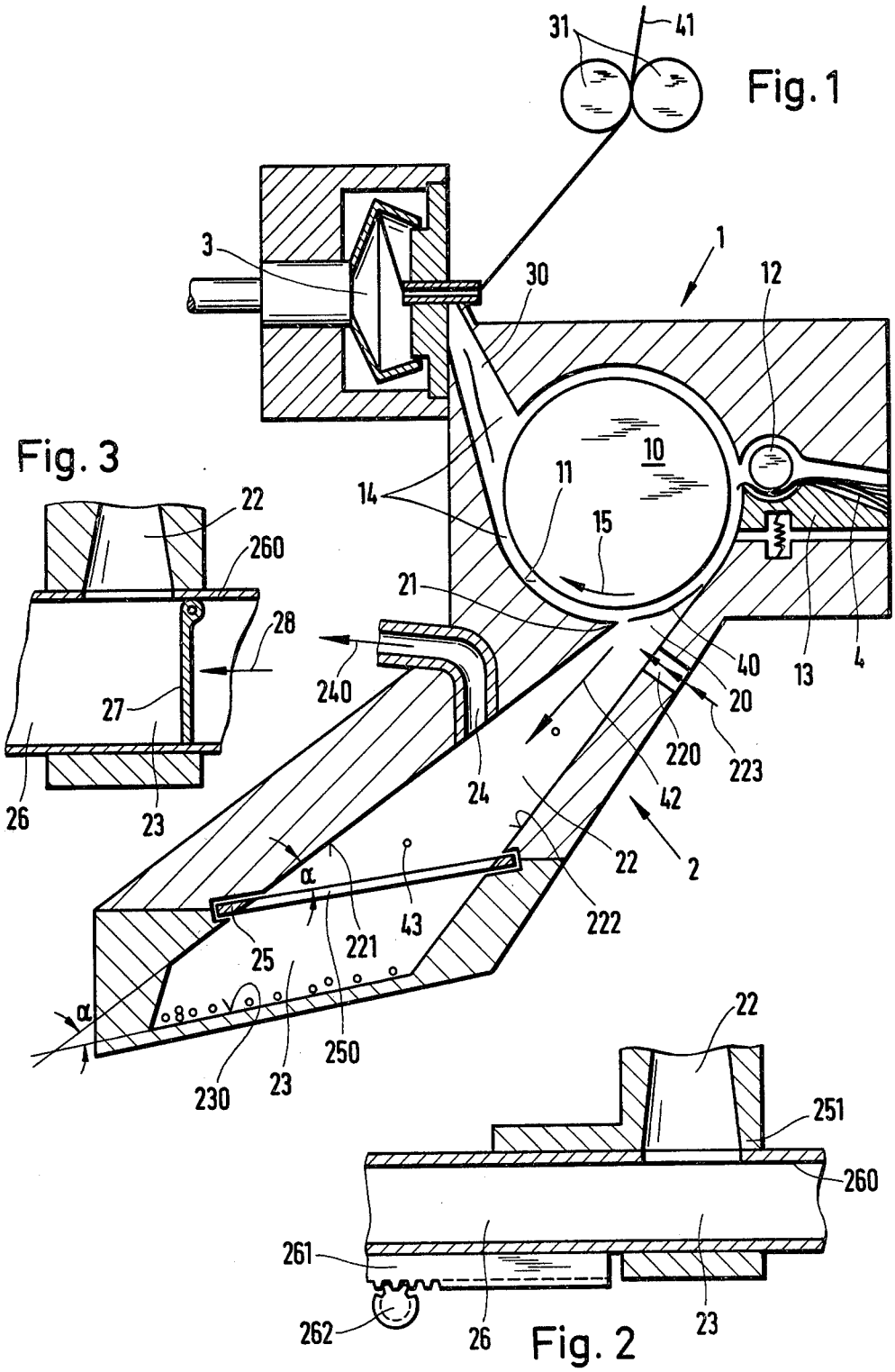
FIG. 1 is a side elevational view illustrating an open-end spinning device, partially in section, equipped with a trash removal system constructed in accordance with the present invention.
FIG. 2 is an enlarged sectional view illustrating a mechanism for removing collected trash from a trash collecting chamber.
FIG. 3 is an enlarged elevational view, partially in section, illustrating a modified form of the invention wherein a particular closure is interposed between an auxiliary chamber and a trash collection chamber.

In an embodiment of the invention, an open-end spinning apparatus with a spinning rotor 3 is shown, but the subject of the invention may also be used in connection with other open-end spinning compartments. For the sake of simplicity, the device according to the invention is also described below only in connection with an opening device 1 working by means of an opening roller 10 but a drawing frame opening means may also be used if desired. Thus, a trash separating device 2, according to the invention, may either be in the housing shell 11 surrounding the opening roller 10 or in a fiber feed passage 30 which leads to the spinning compartment constructed, for example, in the form of a spinning rotor 3.

In the embodiment of the subject of the invention shown in FIG. 1, the sliver 4 is supplied to the opening roller 10 by means of a feed roll 12 and a feeding trough 13 and is separated into individual fibers 40 by this roller 10. The opening roller 10 conveys the individual fibers 40 along a fiber conveying path 14 formed by the periphery of the roller and the housing shell 11 as well as the fiber feed passage 30 into the spinning rotor 3. A thread 41 is produced in known manner in the spinning rotor 3 and is withdrawn by means of a thread withdrawal device 31.

The trash separating device 2 is at a suitable point in the fiber conveying path 14 in known manner. In the embodiment of the invention shown in FIG. 1, this point lies between the point of action of the opening roller 10 on the sliver 4 supplied and the spinning rotor 3. For this purpose, the housing shell 11 is perforated by a trash separating aperture 20 which is bounded by a dividing edge 21 in the direction of rotation of the opening roller 10 marked by an arrow 15. The trash separating aperture 20 is in communication with a trash collecting chamber 23 via an auxiliary chamber 22, although this communication can also be interrupted as will be explained in more detail later.

In order to prevent fibers 40 from emerging through the trash separating aperture 20 to a large extent, an air-inlet aperture 220 orientated substantially in the direction of the arrow 15 leads into the auxiliary chamber 22 and air is continuously supplied through this. As a result of the suction action of the opening roller 10, which is reinforced by the reduced pressure prevailing in the spinning rotor 3, the air enters the fiber conveying path 14 and forms an air curtain which holds back the fibers 40.

The auxiliary chamber 22 extends substantially in the direction of flight of the trash components 43, marked by an arrow 42, so that a return of trash components 43, which have already been extracted, into the fiber conveying path 14, is prevented. In order that the light fly, which clung to the heavier trash components 43 and traversed the air curtain in this manner, cannot be sucked back into the fiber conveying path 14 even after it has been separated from the trash components 43 and so cannot enter the spinning rotor 3 and be bound in the thread 41, an air-outlet aperture 24 is provided in a wall 221 following on the dividing edge 21. The air-outlet aperture 24 is connected to a weak source of reduced pressure (not shown) which, or the effect of which, can be regulated as desired.

A powerful stream of air flows through the first aperture, the air-inlet aperture 220, as indicated by the triple arrow 223. This stream of air is produced by a source of excess pressure or, as already mentioned, by the suction action of the opening roller 10 and possibly the reduced pressure prevailing in the spinning rotor 3 or another spinning compartment.

As the single arrow 240 demonstrates, the stream of air acting in the air-outlet aperture 24 is considerably weaker than the stream of air flowing in through the air-inlet aperture 220. The number of arrowheads and their relationship to one another has nothing to do with the relationship of the strengths of the streams of air to one another but are merely intended to indicate which stream of air is the more powerful.

As shown, the auxiliary chamber 22 is in constant communication with the fiber conveying path 14 because the trash separating aperture 20 cannot be controlled. This is of considerable importance for a continuous separation of trash.

In order that the trash components 43 which have already been extracted can be removed pneumatically from the trash collecting chamber 23 without adversely affecting the trash separation and the conveying of fiber along the fiber conveying path 14, a controllable closing member is provided between the auxiliary chamber 22 and the trash collecting chamber 23. According to the embodiment shown in FIG. 1, this closing member is constructed in the form of a slide 25 provided with an aperture 250.

During the spinning process, the sliver which has been separated into individual fibers 40 is conveyed along the fiber conveying path 14 into the spinning rotor 3. The individual fibers 40 and the trash components 43 come within range of the trash separating aperture 20. While the individual fibers remain in the stream of air flowing along the fiber conveying path 14 because of their lower mass and consequently lower centrifugal force, the heavier trash components are separated out because of their greater mass and consequently greater centrifugal force. Some light fly adheres to the trash components 43 as they enter the separating aperture 20 and become detached from the trash components while the trash components 43 are flying to the trash collecting chamber 23 in the direction of the arrow 42.

In a known trash separating device, the fly tends to settle on the walls 221 and 222, to accumulate and to form large lumps of fly which are then entrained into the fiber conveying path 14, as a result of the reduced pressure prevailing at the opening roller 10 and of the stream of air produced thereby. The lumps of fly enter the spinning rotor 3 where they cause a disturbance in the spinning process, or at least in the appearance of the yarn.

According to the invention, however, the fly detached from the heavier trash components 43 is drawn off continuously through the air-outlet aperture 24.

Since the air-inlet aperture 220 is disposed in the wall 222, a stream of air develops at the upper end of the auxiliary chamber 22. As a result, the fly which is below the air curtain formed is no longer influenced by this stream of air, but is within the range of influence of the air-outlet aperture 24. Thus, the fly is either held back by the air curtain in the fiber conveying path 14, produced by the air-inlet aperture 220 where it does no harm because of uniform distribution between the individual fibers 40, or it penetrates through the air curtain together with the heavier trash components 43 and enters the trash collecting chamber 23 from which it is removed penumatically from time to time, together with the trash components 43, or the fly becomes detached from its carriers after breaking through the air curtain, comes within the range of action of the air-outlet aperture 24 and is carried away. Thus, settling of the fly on the walls 221 and 222 of the auxiliary chamber 22 is effectively avoided.

The arrangement of the walls 221 and 222 of the auxiliary chamber 22 substantially along the direction of flight of the trash components 43, marked by the arrow 42, prevents the free flight of the extracted trash components 43 from being adversely affected so that these cannot rebound into the fiber conveying path 14.

Whereas, the light fly is drawn off continuously as a result of the reduced pressure in the air-outlet aperture 24, the heavier trash components pass through the opening 250 in the slide 25, as mentioned, into the trash collecting chamber 23. Here the trash accumulates and must, therefore, be removed from time to time which is effected in a suitable manner, for example, at fixed intervals. For this purpose, the slide 25 with the aperture 250 (perpendicular to the plane of the drawing) is displaced until the slide 25 interrupts the communication between the auxiliary chamber 22 and the trash collecting chamber 23. The extracted trash components 43 are removed by means of a powerful suction or stream of compressed air which is passed through the trash collecting chamber 23 in a suitable manner, for example, by means of a passage extending along the machine. Meanwhile, the freshly extracted trash components 43 collect in the auxiliary chamber 22 on the slide 25 because the communication between the fiber conveying path 14 and the auxiliary chamber 22 is never interrupted. The lighter trash components 43, the fly and broken pieces of fiber are removed from the slide 25 by the slight reduced pressure produced in the air-outlet aperture 24. They are then drawn off through the air-outlet aperture 24.

When the trash collecting chamber 23 is empty, the suction or stream of compressed air conveyed through the trash collecting chamber 23 is interrupted and the cummunication between the auxiliary chamber 22 and the trash collecting chamber 23 is re-established by displacing the slide 25. The trash components which have accumulated on the slide 25 are stripped off by the slide guide 251 (see FIG. 2) and fall through the aperture 250 into the trash collecting chamber 23.

During the whole time, the trash separation is never ineffective but continues to work continuously without the conveying of fiber along the fiber conveying path 14 being adversely affected despite the pneumatic removal of the trash components 43. Not only are the heavier trash components 43 continuously separated out, but the fly and short fibers reaching the auxiliary chamber 22 are also continuously removed.

The subject of the invention can also be modified. Thus, the fiber conveying path 14 may be formed in the region of the trash separating aperture 20 by a fiber feed passage 30 which connects a drawing-frame feed (not shown) or the housing with the opening roller 10 to the interior of the spinning rotor 3.

The slides 25 of a relatively large group of spinning stations of an open-end spinning machine may form a common member which controls all the spinning stations jointly by a movement in the longitudinal or transverse direction of the machine. In order to avoid, with certainty, a rebound of trash components 43 which have already been extracted, when the slide 25 is open, according to a further feature of the invention, the wall 221 of the auxiliary chamber 22, following on the dividing edge 21 forms an angle $\alpha$ with the baffle 230 of the trash collecting chamber 23 collecting the trash components 43. The angle is selected so that the extracted trash components 43 rebound on the baffle 230, then reach the wall 221 and are removed further from the trash separating aperture 20 with a simultaneous loss of kinetic energy. For this purpose, an angle $\alpha$ which is less than 30 degrees has proved particularly advantageous. In order to obtain this effect even when the slide 25 is closed, the slide 25 may also be disposed parallel to the baffle 230 and so likewise form an angle $\alpha$ of this order of magnitude with the wall.

A slide 25 does not necessarily have to be used as a closing member and the closing member can vary in construction. According to FIG. 2, for example, the trash collecting chamber 23 is part of a passage 26 which extends over a plurality of spinning stations and which is displaceable in the longitudinal direction in a suitable manner until the communication between the auxiliary chamber 22 and the trash collecting chamber 23 is interrupted by the passage wall 260 forming the closing member. A rack 261, for example, may be provided on the outer wall of the passage for this purpose in which rack there engages an appropriately controllable pinion 262.

The control of the air through chamber 23 and the control of the closing member are effected synchronously from one and the same control point. As FIG. 3 shows, the stream of air 28 can also be used directly to control the closing member in that a freely hanging flap 27 is provided in the passage 26 which flap can be brought to bear against the upper passage wall 260 by the stream of air 28. Naturally, however, the flap 27 may also be controlled by its own drive means.

As the description shows, the subject of the invention can be modified in many ways. The individual features may also be replaced by equivalents.

The subject of the invention renders possible an uninterrupted separation of trash and prevents the accumulation and the sucking back of fine trash components despite intermittent pneumatic removal of trash.

What is claimed is:

1. An open-end spinning apparatus having a fiber conveying path between a fibrous material feed device and a spinning compartment, a trash separating device including a trash-separating aperture communicating with said fiber conveying path through which air is supplied to said fiber conveying path, said aperture being bounded on one side by a dividing edge, and a trash collecting chamber receiving trash removed through said aperture of said trash-separating device, the improvement comprising:

an auxiliary chamber carried between said aperture of said trash-separating device and said trash-collecting chamber, opposed walls forming part of said auxiliary chamber, a first aperture extending through one of said walls through which a stream of air flows for being introduced into said fiber conveying path, a second aperture provided in said other wall through which a smaller stream of air is removed from said auxiliary chamber for aiding in removing small particles of said trash from said auxiliary chamber, a controllable closing member disposed between said auxiliary chamber and said trash collecting chamber, means for selectively opening said closing member for allowing trash separated from said fibrous material to be deposited in said collecting chamber and for selectively closing said closing member sealing said auxiliary chamber from said trash collecting chamber, and means for cleaning said collecting chamber while said closing member is closed.

2. The open-end spinning apparatus as set forth in claim 1 wherein said means for cleaning said collecting chamber comprises:

a stream of air flowing through said trash collecting chamber for removing trash therefrom, and said controllable closing member including a movable flap which is moved by said stream of air providing a closure between said auxiliary chamber and said trash collecting chamber when said stream of air is being used for removing trash from said collecting chamber.

3. The open-end spinning apparatus as set forth in claim 1 further comprising:

said other wall of said auxiliary chamber extending downwardly from said dividing edge;

said trash collecting chamber including a baffle upon which said removed trash is collected, and said other wall of said auxiliary chamber forms an angle of less than 30° with said baffle.

4. The open-end spinning apparatus as set forth in claim 1 further comprising:

said other wall of said auxiliary chamber extending downwardly from said dividing edge and forms an angle of less than 30° with a face of said closing member.

5. A trash removal device for use on an open-end spinning apparatus having a fibrous material conveying path extending around an opening roller between a fibrous material feed device and a spinning compartment, a trash separating device including a trash-separating aperture communicating with said fiber conveying path, and a trash collecting chamber receiving trash removed through said trash-separating aperture from fibrous material as said material is fed along said fibrous material conveying path, said trash removal device comprising:

an auxiliary chamber including a surrounding wall carried between said aperture of said trash separating device and said trash collecting chamber, a first aperture provided in said wall of said auxiliary chamber through which a first air stream flows for being introduced into said fibrous material conveying path, a second aperture provided in said wall of said auxiliary chamber, means for withdrawing a smaller stream of air through said second aperture from said auxiliary chamber for aiding in removing small particles of trash from said auxiliary chamber, a controllable closing member disposed between said auxiliary chamber and said trash collecting chamber for selectively providing a seal between said auxiliary chamber and said collecting chamber, and means for supplying a stream of air through said collecting chamber for removing trash therefrom, whereby trash can be removed from said collecting chamber by means of a stream of air when said closing member provides a seal between said auxiliary chamber and said collecting chamber without adversely affecting the spinning operation of said open end spinning apparatus.

6. The open-end spinning apparatus as set forth in claim 1 wherein:

said wall with said second aperture extends from said dividing edge, and said wall with said first aperture is arranged opposite said other wall so that said stream of air is introduced substantially in the direction of conveyance of the fibers.

* * * * *